United States Patent [19]

Smith

[11] 4,159,138

[45] Jun. 26, 1979

[54] SNAP-ACTING LATCH MECHANISM FOR SLIDING DOORS AND THE LIKE

[76] Inventor: Donald V. Smith, 101 Conastoga Dr. #74, Carson City, Nev. 89701

[21] Appl. No.: 849,655

[22] Filed: Nov. 8, 1977

[51] Int. Cl.[2] ..... E05C 3/22

[52] U.S. Cl. ..... 292/214; 292/341.15

[58] Field of Search ..... 292/214, 59, 204, 209, 292/341.15, 199, 91

[56] References Cited

U.S. PATENT DOCUMENTS

| | | | |
|---|---|---|---|
| 554,701 | 2/1896 | Krupp | 292/199 X |
| 986,808 | 3/1911 | Cesare | 292/341.15 X |
| 1,081,634 | 12/1913 | Smith | 292/199 |
| 1,967,627 | 7/1934 | Riley et al. | 292/341.15 |
| 3,094,347 | 6/1963 | May | 292/341.15 X |
| 4,045,064 | 8/1977 | Okada | 292/DIG. 14 |

*Primary Examiner*—Ronald E. Moore

*Attorney, Agent, or Firm*—Warren, Chickering & Grunewald

[57] ABSTRACT

A snap-acting latch mechanism for sliding doors is disclosed in which a latch bar is rotatably mounted and extends from a latch assembly for insertion into a keeper assembly. The keeper assembly is formed for cooperative engagement of a head portion of the latch bar to retain the same against withdrawal and yet the latch bar can be rotated to a position enabling withdrawal from the keeper assembly. In the improved mechanism of the present invention the keeper assembly includes a pair of resilient band means mounted in side-by-side, spaced apart relation so as to snap into engagement behind the head of the latch bar and yet enable withdrawal of the latch bar upon rotation of the head by 90°.

2 Claims, 5 Drawing Figures

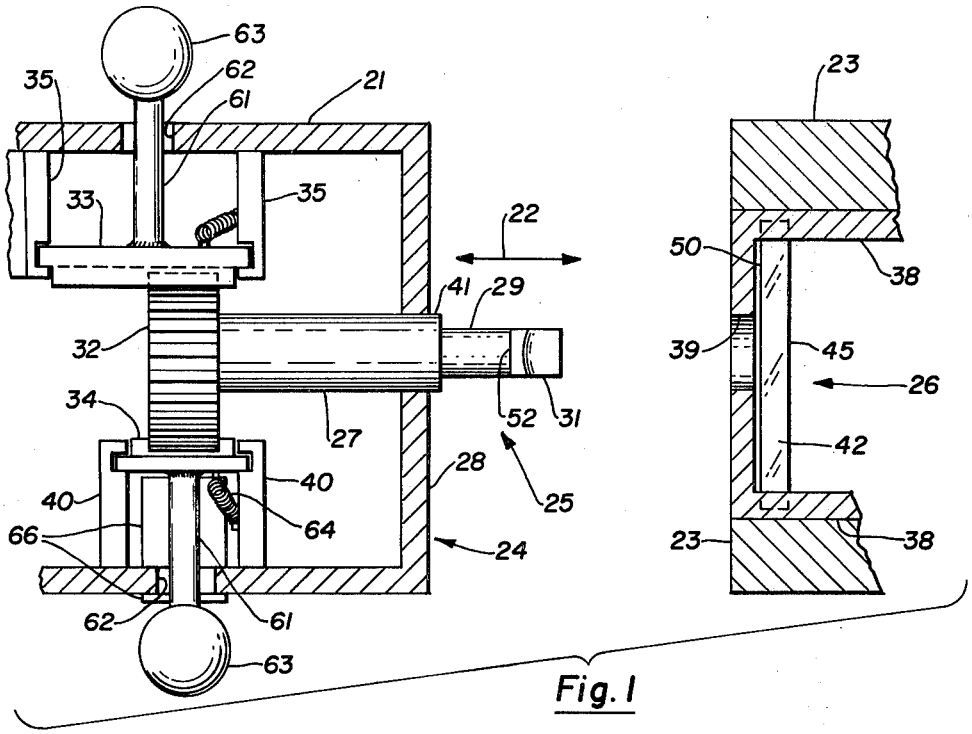
Fig. 1
Fig. 2
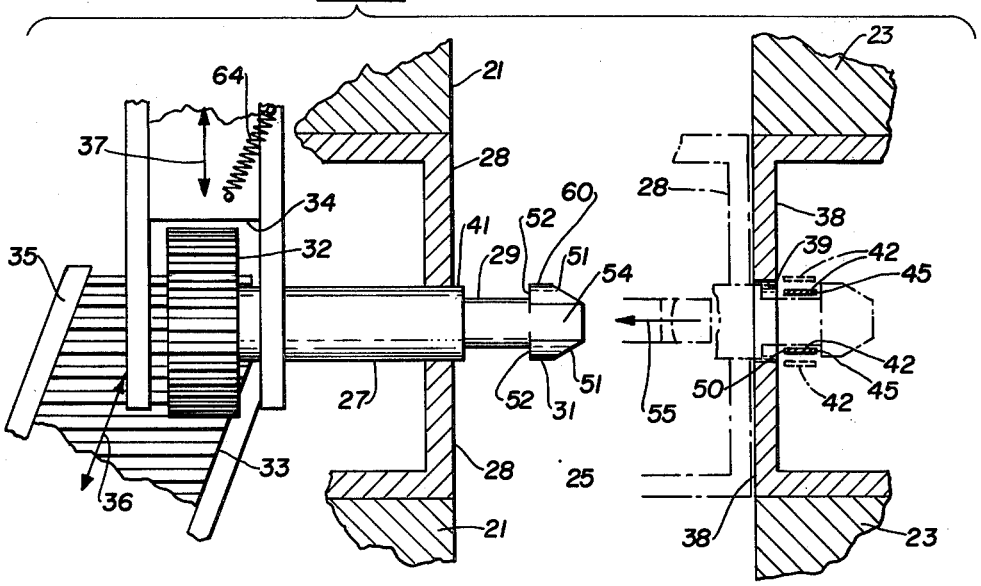
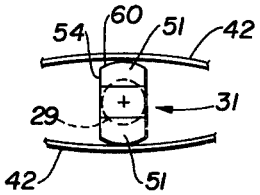
Fig. 3
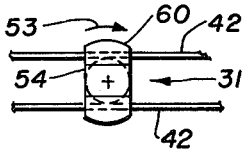
Fig. 4
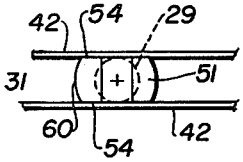
Fig. 5

SNAP-ACTING LATCH MECHANISM FOR SLIDING DOORS AND THE LIKE

BACKGROUND OF THE INVENTION

The widespread use of sliding glass doors and windows in modern homes has brought with it serious security problems. The latch mechanisms conventionally employed in sliding glass doors are often readily susceptible to unauthorized forced opening. Such latch mechanisms often include a hook-like latching or draw bar, and the sliding glass doors can often be lifted on their guide tracks to allow unhooking of the latch bar.

A further problem in connection with many sliding glass door latch mechanisms has been that they are not capable of being locked and unlocked from outside the door. In large apartment houses it is not uncommon for one side of the apartment house to have front or entry doors, with the opposite side of the apartment house having sliding glass doors. The side of the apartment house with the sliding glass doors, however, also often includes the garage structures. Thus, the resident of the apartment house must lock the sliding glass door from the inside, leave his apartment from the front door, and walk all the way around the building to the back where the garage is located. This procedure, of course, is reversed upon his return, and could be short-circuited with much improved convenience if the sliding glass door could be locked and unlocked from the outside thereof.

The prior art does include plug-in latch mechanisms of the type in which a latching bar or element is inserted into a keeper assembly until it is in a latched position which is held against withdrawal by the keeper assembly. Such prior art also teaches the rotatable mounting of the latch bar for release of the same from the keeper assembly. U.S. Pat. Nos. 554,701, 1,836,970, 1,875,768, 1,967,627, 2,118,729, 2,486,003, 3,026,702 and 3,133,168 are illustrative of prior art found in connection with a search of the present invention which disclose plug-in type latch mechanisms which are rotatable to effect release, but which do not disclose the improved latch mechanism of the present invention.

SUMMARY OF THE INVENTION

Accordingly, it is an object of the present invention to provide a latch mechanism which can be used in connection with sliding doors, and particularly sliding glass doors, while affording a positive, high strength, latch which is resistant to forced entries and which can be locked from either side of the door.

It is another object of the present invention to provide a snap-acting lock mechanism which is simple and inexpensive to construct, has a minimum of moving parts, is durable, is easy to maintain, can be readily repaired and can be installed as original equipment or as a replacement latch for sliding glass doors.

The latch mechanism of the present invention has other objects and features of advantage, which will become apparent from and are set forth in more detail in the accompanying drawing and following description of the preferred embodiment.

The snap-acting latch mechanism of the present invention includes a latch assembly and keeper assembly formed and mounted for cooperative engagement of a latch bar to effect latching of the same and release of the latch bar upon rotation for withdrawal of the bar from the keeper assembly. The improvement in the latch mechanism of the present invention comprises, briefly, the keeper assembly being formed to include spaced apart, side-by-side band means mounted to extend transversely of the latch bar at a spaced distance less than the enlarged head portion of the latch bar with the band means being resiliently biased to enable lateral displacement for passage of the head therebeyond and snap action of the bands into engagement with shoulders on the head of the latch bar. The bands are preferably formed from spring steel strips with the side edges of the strips engaging the shoulders on the head portion so as to provide a high strength coupling of the latch bar to the keeper assembly. The mechanism further includes manually engageable latch release means coupled for rotation of the latch bar together with lock means formed for selective locking of the latch release means against rotation of the latch bar from a position outside of the door on which the latch mechanism is mounted.

DESCRIPTION OF THE DRAWING

FIG. 1 is a fragmentary, top plan view, partially in cross-section, of a latch mechanism constructed in accordance with the present invention.

FIG. 2 is a fragmentary, side elevational view, partially in cross-section, of the latch mechanism of FIG. 1, with moved positions shown in phantom.

FIG. 3 is a fragmentary, end elevational view of the latch bar and keeper band means of the present invention shown during the latching process.

FIG. 4 is an end elevational view corresponding to FIG. 3 with the latch bar shown in latched position.

FIG. 5 is an end elevational view corresponding to FIG. 3 with the latch bar rotated for release and withdrawal from the keeper band means.

DESCRIPTION OF THE PREFERRED EMBODIMENTS

Referring now to FIGS. 1 and 2, the latching mechanism of the present invention is shown mounted to a sliding door 21 which is mounted for reciprocal movement as indicated by arrow 22 to and from door jamb or door frame 23. The latch mechanism includes a latch assembly, generally designated 24, and a keeper assembly, generally designated 26, which are shown mounted respectively to door 21 and frame 23. As will be understood, it is possible to reverse the mounting of the latch assembly and keeper assembly so that keeper assembly 26 is mounted to the movable door 21 and the latch assembly is mounted to frame 23; however, the more conventional and preferred mounting of the latch and keeper assemblies is shown in FIG. 1.

In order to enable selective latching and unlatching of the present mechanism, latch assembly 24 includes a latch bar, generally designated 25, which is mounted to the latch assembly for selective rotation to and from a latched and an unlatched position. The latch bar includes an enlarged shank portion 27, a reduced neck portion 29 and an enlarged head portion 31, and the latch bar extends or protrudes outwardly of latch assembly housing 28 for insertion into keeper assembly 26. Keeper assembly 26 is formed for cooperative engagement with head portion 31 of the latch bar when the latch bar is in latched position to retain the head portion against withdrawal from the keeper assembly. The keeper assembly is further formed to release the head portion 31 upon rotation of the latch bar to an unlatched position.

As thus far described, the latch mechanism of the present invention has elements broadly found in various prior art devices. In the improved latch assembly of the present invention, the keeper assembly 26 is formed to include a pair of spaced apart, side-by-side band means 42 mounted to extend transversely of latch bar 25 at a spaced distance from each other less than a first dimension of head portion 31 of the latch bar.

As best may be seen in FIGS. 3, 4 and 5, the head portion 31 of rotatable latch bar 25 is elongated or enlarged in the vertical direction in FIGS. 3 and 4 relative to the diameter of neck portion 29. This enlarged diameter is herein referred to as the "first dimension" of head portion 31. The head portion 31 is further reduced in its horizontal or transverse dimension, as viewed in FIGS. 3 and 4, and this horizontal or lateral dimension is referred to as the "second angularly displaced dimension."

As will be appreciated, the first dimension is here shown to be vertically oriented in the latched position of FIGS. 3 and 4. It would be possible to have the first dimension be horizontally oriented with bands 42 running vertically inside keeper assembly 26. Accordingly, the first dimension need not necessarily be vertical in direction, and in fact can be oblique to the vertical axis, so long as bands 42 are transversely oriented and formed for resilient lateral displacement during advancement of the first dimension of head portion 31 therebetween.

In FIGS. 1, 2, 3 and 4, the latch bar 25 is shown in the latched position for insertion into the keeper assembly and automatic latching thereof. Thus, as door 21 closes, the head 31 is pushed past and laterally displaces bands 42, which are resiliently biased to snap back from their laterally displaced position so that the edges 45 of the bands engage oppositely facing shoulders 52 on head portion 31 to thereby retain the latch bar against withdrawal from the keeper assembly.

Unlatching of the mechanism of the present invention is accomplished by rotation of the latch bar. Such rotation may be provided in a number of different manners, but as here shown, a pinion gear 32 is mounted on the inner end of shank portion 27 of the latch bar, and the pinion gear is fixed for rotation with the latch bar. Gear 32 is driven by a first rack 33 extending vertically parallel to the door on the side of the door which would normally be the inside. A second rack 34 extends vertically parallel to the door on the side of the door that would normally be the outside. Rack 33 is mounted in guide means 35 for reciprocation in the direction of arrow 36 to cause rotation of pinion gear 32 and latch bar 25. Similarly, a downward movement of rack 34 within guide means 40, as indicated by arrow 37, will produce rotation of pinion gear 32 and latch bar 25. Each of racks 33 and 34 can be provided with arms 61 which extend outwardly of the latch assembly housing 28 through a vertical slot or the like 62 and have mounted thereon a manually engageable member 63 to enable reciprocation of the racks. Additionally, it is preferable that each of racks 33 and 34 be spring biased, as by tension springs 64, for automatic return of the latch bar to the position of FIGS. 1–4.

The keeper assembly 26 includes a housing 38 which is secured to door frame or jamb 23 by fasteners or the like. Formed in general axial alignment with head 31 of the latch bar is an opening 39 in housing 38, which opening is dimensioned to receive the protruding end or shoulder 41 of shank 27 of the latch bar. This can best be seen in phantom in FIG. 2. The protrusion of the shoulder or end 41 of the relatively large diameter shank 27 into opening 39 provides additional security in that the relatively large diameter shank 27 will make it more difficult for burglar tools to be used to sever the shank, than would be true of the reduced neck portion 29. Additionally, the end of the shank 41 is inserted beyond the housing 38 outer surface so that a tool cannot be inserted therebetween to pry the latch bar out of the keeper housing.

It is preferable to form the band means of the present invention as a pair of side-by-side spring steel bands or strips which are secured to the housing 38 at the ends thereof, as best seen in FIG. 1. Spring steel provides the necessary resiliency and engagement with the back edges 45 of the steel bands provides a high strength keeper assembly. Thus, if one tries to pull the door open during a forced entry, the front edges 50 of the bands are positioned for support by the inside of the housing and the elongated cross-section of the bands provides a high strength support of the head against withdrawal. Thus, when the head portion 31 is in the position shown in phantom lines in FIG. 2 beyond the back edges 45 of bands 42, it is extremely difficult to withdraw the latch bar 25 from the keeper assembly during a forced entry, unless the latch bar is rotated.

It is further preferable that the bands 45 be spaced apart at a distance about equal to the second angularly displaced dimension, in this case the diameter of neck 29.

The release of the latch mechanism can be accomplished by manually advancing either of racks 33 or 34 for rotation of latch bar 25 in the direction of arrow 53 in FIG. 4. Such rotation will orient head 31 to the position shown in phantom in FIG. 2 and in solid lines in FIG. 5.

As best can be seen in FIGS. 3–5, head 31 is formed with parallel flat sides 54, which are spaced apart at a distance about equal to the diameter of neck 29 and preferably slightly less or about equal to the distance between parallel bands 42. In the rotated position of FIG. 5, shoulders 52 on head 31 will no longer engage the back edges 45 of band 42, and the latch bar is free to be withdrawn from the keeper assembly by movement in the direction of arrow 55 in FIG. 2.

It is generally preferable that the latch mechanism be constructed so that rack 33 operated from the inside of the door is not formed with a lock mechanism, but that rack 34 on the outside of the door is formed with lock means 66, such as a tumbler lock, so that the outer rack can be locked in a fixed position from outside the door.

It is also further preferable that racks 33 and 34 are formed for independent movement. This can be accomplished by spring biasing rack 34 to a position, as is shown in FIG. 2, at which it is out of engagement with pinion 32. Rack 33, by contrast, is still in engagement with pinion 32. Thus, rack 34 can be locked by lock means 66 on the outside of the door so that it cannot engage pinion 32 to enable rotation of head 31 and release of the latch. Notwithstanding the fact that rack 34 is locked against movement, it is still possible to open the door from the inside by pushing manually engageable member 63 from the inside of the door to release the latch mechanism. As will be appreciated, however, it is possible for the latching mechanism of the present invention to include locking means formed to enable selective locking of rack 33 against movement, in a manner similar to that shown for rack 34. Additionally, both racks can be formed and mounted to be in engagement with the pinion 32 at all times, if desired.

In order to enable lateral displacement of bands 42 during insertion of head portion 31, it is preferable that the head portion include a tapered surface 51 having an inner small end which is dimensioned for insertion between the band 42 and terminating in an arcuate or round band engaging section 60 immediately in advance of shoulders 52. The arcuate section 60 minimizes the wear on bands 42 by conforming to the bands, as best may be seen in FIG. 3, which naturally assume an arcuate configuration as they are laterally displaced.

In this regard, it should be noted that the distance between the zone or area which enlarged head 31 engages bands 42 to the position at which the ends of the bands are secured to the keeper assembly housing 38 is preferably equal to at least one diameter of the enlarged head. Moreover, bands 38 may be advantageously mounted in slots in housing 38 so that upon bowing of the bands during lateral deflection, the ends can move slightly to minimize internal stress in the bands. It might also be noted that a single band which is looped back upon itself can be employed to provide the side-by-side band means, but more preferably two discrete band means 42 are employed.

The rotatable nature of the latch mechanism of the present invention makes it most difficult for unauthorized personnel to make a forced entry through the latch mechanism. While it is always possible to use extreme force and destroy such a latch mechanism, the mechanism of the present invention is highly secure and not susceptible to covert or surreptitious unlatching.

What is claimed is:

1. A latch mechanism for a sliding door or the like, said latch mechanism including a latch assembly and a keeper assembly, said latch assembly having a latch bar mounted thereto for selective rotation from a latched position to and from an unlatched position, said latch bar being further mounted to extend from said assembly and having an enlarged head portion with a first dimension thereof greater than a second angularly displaced dimension thereof, said keeper assembly including resiliently displaceable band means formed for cooperative engagement with said head portion when said latch bar is in said latched position to retain said head portion against withdrawal from said keeper assembly and being formed to release said head portion for withdrawal therefrom when said latch bar is rotated to said unlatched position, wherein the improvement in said latch mechanism comprises:

said latch assembly includes manually engageable latch release means coupled to enable selective rotation of said latch bar to said unlatched position from either side of said door, said latch release means being formed as a pinion gear mounted to said latch bar for rotation therewith and two independently movable rack elements formed for manual engagement and formed to drivingly engage said pinion gear upon manual displacement thereof.

2. A latch mechanism as defined in claim 1 wherein, one of said rack elements of said latch release means is normally biased from a position of driving engagement with said pinion gear to a position out of engagement with said pinion gear, and a remainder of said rack elements is engaged with said pinion gear over the full range of movement thereof;

and lock means mounted to said latch mechanism and formed to enable selective locking of said remainder of said rack elements against movement.

* * * * *